United States Patent [19]

Babbage

[11] 4,325,310

[45] Apr. 20, 1982

[54] BOILERS

[75] Inventor: Thomas A. Babbage, Walton-on-Thames, England

[73] Assignee: Trianco Redfyre Limited, Sheffield, England

[21] Appl. No.: 177,240

[22] Filed: Aug. 11, 1980

[30] Foreign Application Priority Data

Aug. 13, 1979 [GB] United Kingdom ..... 28143/79

[51] Int. Cl.[3] ..... F23K 3/00

[52] U.S. Cl. ..... 110/101 R; 110/108; 110/116; 110/267; 110/293; 110/327; 222/559

[58] Field of Search ..... 110/116, 108, 102, 293, 110/101 R, 101 LD, 117, 118, 255, 256, 267, 327; 222/559, 561

[56] References Cited

U.S. PATENT DOCUMENTS

| | | | |
|---|---|---|---|
| 1,523,679 | 1/1925 | Wynne | 110/116 |
| 1,698,771 | 1/1929 | Tellechea | 110/293 |

FOREIGN PATENT DOCUMENTS

| | | | |
|---|---|---|---|
| 240630 | 10/1964 | Austria | 222/559 |
| 75649 | 3/1953 | Denmark | 222/559 |
| 1080318 | 8/1967 | United Kingdom | 110/255 |

*Primary Examiner*—Edward G. Favors

*Attorney, Agent, or Firm*—Shoemaker and Mattare, Ltd.

[57] ABSTRACT

In an automatic boiler having an internal hopper, a regulator plate 12 controls the flow under gravity of fuel to the firebed. For small particled fuel in particular the plate is provided with a torque 23 which causes a central thinning of the firebed. Thus, a centrally disposed shallow firebed is formed so that primary air can rapidly break through at this point to burn off volatile gases as they are distilled and cause ignition over the whole firebed.

6 Claims, 3 Drawing Figures

BOILERS

FIELD OF THE INVENTION

The invention relates to boilers of the kind having an internal hopper from which fuel is fed in use to a fire bed. More particularly, the invention is advantageously applicable to boilers for burning small particuled fuels such as screened anthracite of screened particle sizes known as Rice or Barley. These screen sizes respectively provide particle sizes of 3/16" to 5/16" and 3/32" to 3/16".

SUMMARY OF THE INVENTION

It is an object of the invention to provide a boiler capable of operating on a supply of small particled fuels.

According to the invention there is provided a boiler having an internal hopper provided with an extended throat arranged to supply fuel down a sloping support to a fire bed, including a regulator extending generally across said throat for controlling flow of fuel having one or more tongues arranged to at least substantially prevent the flow of fuel at one or more corresponding regions of said throat.

DESCRIPTION OF THE DRAWINGS

Referring to FIG. 1, the boiler includes a hopper 10 having a throat 11 extending across the boiler and a regulator plate 12 positioned to control the effective size of said throat and hence control the flow of fuel down a sloping support 13. The regulator plate 12 is adjustable (to enable the boiler to be used with a wide variety of fuel sizes as will be explained more fully later) being supported by a locating pin 14. A fan 15 controlled by a thermostat 16 provides primary air directly to the fire bed from below a combustion chamber 17 and secondary air via one or more ducts 18.

The boiler is provided in conventional manner with a flue 19, flueways 20, clinker ejection ram 21 with clinker ejection mechanism, and a clinker tray 22. A water jacket is provided surrounding the fire bed and flueways 20.

Figure 1:
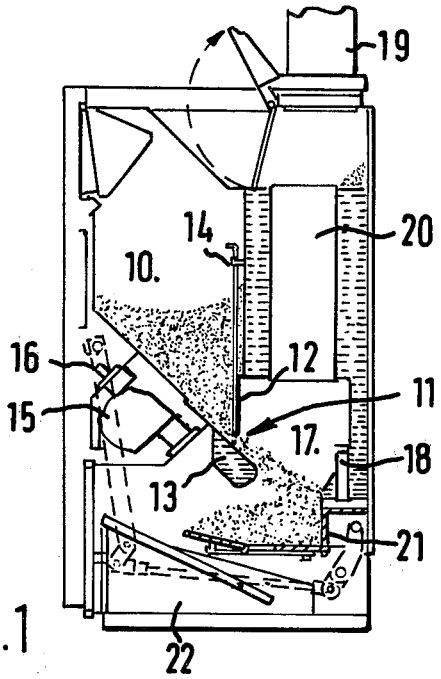
FIG. 1 shows a part-sectioned view of the boiler.
Figure 2:
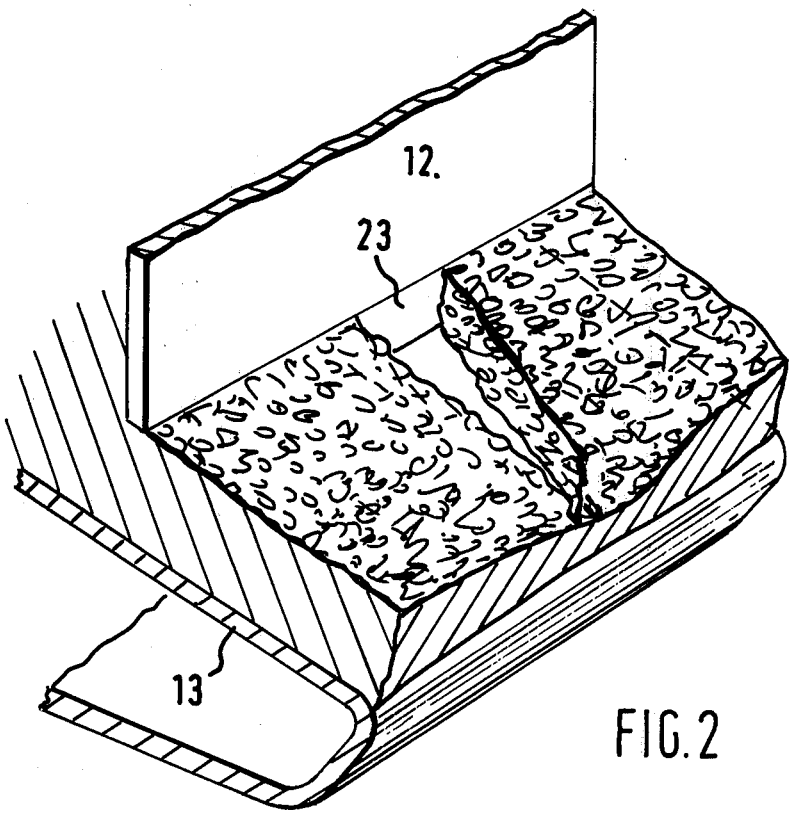
FIG. 2 shows a cut-away isometric view of a fire bed of the boiler in use.

In FIG. 2, the regulator 12 has a tongue 23 which abuts the support 13. It can be seen clearly in the drawing that the tongue 23 prevents flow of fuel so that just beyond or downstream of the tongue 23 no fuel is present on the support 13. Due to the natural angle of repose of the fuel, fuel particles provide a comparatively shallow fire-bed in a central position. We have found that, especially with chosen relative dimensions, this provides good combustion conditions which can be maintained even with an automatic control and consequent cyclic operation of the boiler.

In the arrangement shown, the boiler is adjusted for burning (Rice) screened anthracite. The regulator 12 is 300 mm wide and separated from the support 13 by 25 mm. The tongue 23 is 75 mm wide and the support 13 extends 100 mm beyond the regulator 12. For burning Barley, the regulator 12 is adjusted to be separated from the support 13 by 20 mm.

It will be appreciated that these dimensions can be altered somewhat in other embodiments of the invention and advantages provided by the invention can still be realised. Surprisingly, we have found with fuels generally of the Rice and Barley sizes that if a ratio between the width of the tongue 23 and the length of the support 13 is maintained at least approximately three to four considerable advantages are achieved in boiler performance and efficiency of combustion.

Hitherto in order to adjust boilers for smaller sized fuel it was usual to reduce the effective exit throat size of the hopper. So far boilers have not operated satisfactorily with particled sized fuel less than about ¼". Once particles below this size are used difficulties arise because the fire bed tends to become too dense. When the boiler fan is required to operate against this high resistance an increase in the distillation of the volatile gases occurs which tend to accumulate above the fire bed before a flame ignition is achieved. A delay in ignition can cause minor explosions (blow-back) to the detriment of the boiler parts and flue fittings. However, if this problem is attempted to be resolved by reducing the exit throat dimensions further, fuel tends to be held-up by the regulator. Thus, reduction of exit throat size does not provide a solution.

It is desirable to have a fuel supply formation which is sufficiently thick at the edges to minimise flow of primary air up the side of the fire box. At the same time a rapid ignition of the fire bed face is preferable as soon after the primary air draught is provided as possible to burn off any accumulation of combustible gases to prevent blow back. In embodiments of the present invention, a centrally disposed shallow fire bed exists so that primary air can rapidly break through at this point to burn off volatile gases as they are distilled and cause ignition over the whole of the fire bed while retaining a relatively thick edge fire-bed.

The central shallow fire bed is particularly useful for a declinkering sequence. The disturbance caused by clinkering causes a considerable quantity of fresh fuel to flow into the fire box and emit highly volatile gases. The shallow fire bed region enables a continuity or early re-establishment of ignition so that such gases can be burned off before substantial accumulation. This reduces any tendency to blow back and provides improved combustion efficiency.

In a boiler where the throat extends, say, 350 or 400 mm, we prefer to provide more than one tongue with consequent provision of more than one shallow fire bed region in use. We have found that the ratio explained above of three to four continues to offer an optimum result. Where there is more than one tongue provided, they are positioned preferably so as to provide two or more shallow fire bed regions evenly distributed across the width of the fire bed.

Figure 3:
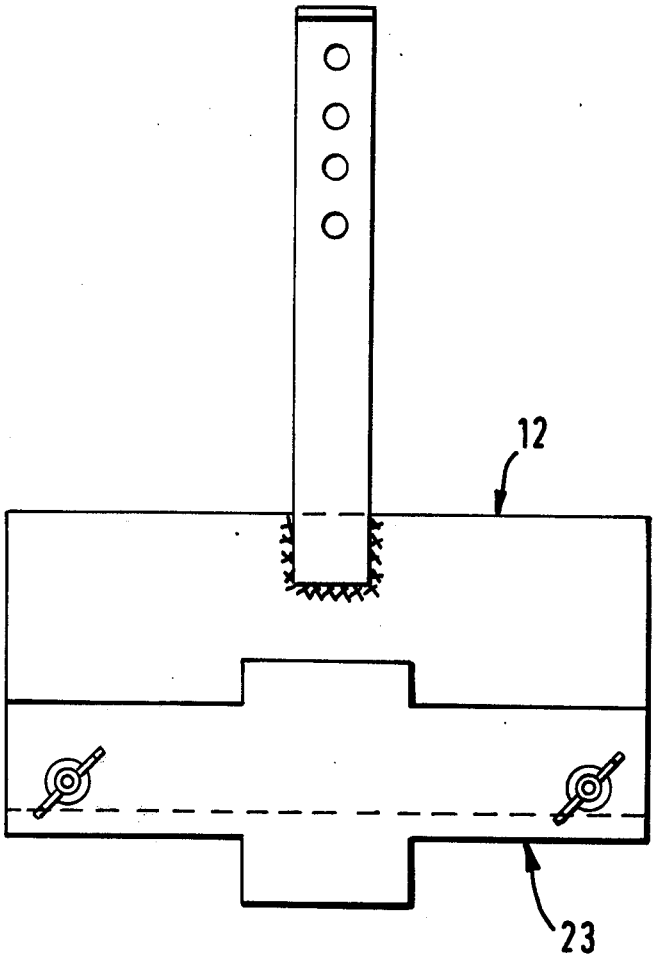
FIG. 3 shows an elevation of one regulator for the boiler.

In FIG. 3, the general purpose regulator 12 is shown. Normally, the tongued shape is only required for small particled fuel as described. Thus, this lower part of the regulator can be bolted (or otherwise attached) to a standard regulator plate as is used above for fuels of larger and much larger particle sizes. The tongued plate 23 is preferably reversible so that one tongued plate can be provided to suit the particular fuel being used, where for example, as mentioned earlier, the general separation of the plate 12 is either 20 or 25 mm from the support 13.

I claim:

1. A heating boiler comprising in combination:

a combustion chamber;

a hopper having a throat opening into one side of the combustion chamber at a level such that solid fuel pellets in said hopper flow out to form a firebed until the surface of the firebed slopes downwardly from said throat at the natural angle of repose of said fuel pellets;

a thermostatically controlled fan operable to cause primary air to flow through the firebed;

a support that slopes downwardly into the combustion chamber for an initial portion of the downward travel of the fuel pellets;

a regulator extending generally across said throat for controlling flow of fuel pellets from said hopper; and means on said regulator for defining a localized thinning of the firebed so that the firebed is shallow at the localized region with respect to the thickness of the firebed adjacent said localized region, said means including a tongue mounted on said regulator, said tongue having a longitudinal area less than the cross-sectional area of said throat so that the tongue at least substantially prevents the flow of fuel pellets at one region of said throat downstream of said tongue so that a localized shallow region forms in the firebed through which breakthrough of primary air is facilitated and controlled while maintaining a thick edged firebed, said regulator being spaced from said support so that the effective throat, between the regulator and the support, is less than about 40 mm so that fuel pellets having sizes equal to or less than about 5/16 inch can be efficiently handled by the boiler.

2. A boiler according to claim 1, in which the sloping support extends beyond the regulator and said tongue has a width equal to at least approximately three quarters the length that the sloping support extends beyond the regulator.

3. A boiler according to claim 1, in which the tongue is positioned centrally with respect to the width of the support.

4. A boiler according to claim 1, in which the tongue is detachably mounted on the regulator.

5. A boiler according to claim 1, in which said regulator is provided with an adjustable tongue support plate which is detachably fixed to the regulator.

6. A boiler according to claim 1 including a plurality of tongues.

* * * * *